US009711340B1

(12) United States Patent
Weisbrod et al.

(10) Patent No.: US 9,711,340 B1
(45) Date of Patent: Jul. 18, 2017

(54) PHOTO-DISSOCIATION BEAM ALIGNMENT METHOD

(71) Applicant: Thermo Finnigan LLC, San Jose, CA (US)

(72) Inventors: Chad R. Weisbrod, San Jose, CA (US); Christopher Mullen, Menlo Park, CA (US); John E. P. Syka, Charlottesville, VA (US); Jae C. Schwartz, Gilroy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/165,062

(22) Filed: May 26, 2016

(51) Int. Cl.
*H01J 49/00* (2006.01)
*H01J 49/10* (2006.01)
*H01J 49/42* (2006.01)

(52) U.S. Cl.
CPC ..... *H01J 49/105* (2013.01); *H01J 49/4225* (2013.01)

(58) Field of Classification Search
None
See application file for complete search history.

(56) References Cited

U.S. PATENT DOCUMENTS

| | | | | |
|---|---|---|---|---|
| 7,312,441 | B2 | 12/2007 | Land et al. | |
| 7,960,690 | B2 | 6/2011 | Schwartz et al. | |
| 8,198,580 | B2 | 6/2012 | Schwartz et al. | |
| 9,202,681 | B2 | 12/2015 | Remes et al. | |
| 2007/0272849 | A1* | 11/2007 | Kirihara | H01J 49/0422 250/288 |
| 2011/0049347 | A1* | 3/2011 | Wells | H01J 49/0054 250/282 |
| 2011/0168883 | A1* | 7/2011 | Furuhashi | H01J 49/0059 250/288 |

* cited by examiner

*Primary Examiner* — Andrew Smyth
(74) *Attorney, Agent, or Firm* — A. J. Gokcek

(57) ABSTRACT

A method of aligning a light beam within a mass spectrometer includes providing precursor ions along a longitudinal axis of the mass spectrometer at two or more precursor ion locations, the precursor ion locations being spatially separated along the longitudinal axis of the mass spectrometer, the precursor ions forming in-vacuum targets. The method then includes directing a light beam from a light source in a direction along the longitudinal axis of the mass spectrometer, the light beam photo-dissociating the precursor ions, and monitoring a mass spectrometer ion signal from each of the two or more precursor ion locations while adjusting the direction of the light beam, thereby aligning the light beam within the mass spectrometer.

31 Claims, 9 Drawing Sheets

PHOTO-DISSOCIATION BEAM ALIGNMENT METHOD

FIELD OF THE INVENTION

The invention is generally related to aligning a light beam within a mass spectrometer.

BACKGROUND

Light source alignment is necessary for efficient generation of product ions and minimization of noise (e.g., due to photo-desorption and photo-ionization from instrument surfaces) in ultraviolet light ($\lambda$<400 nm, e.g., 213 nm) photo-dissociation (UVPD) and infrared multiphoton dissociation (IRMPD) mass spectrometry. Alignment of the light source is typically achieved by placement of two or more target apertures along the light path. Light source adjustment is performed until the light is sufficiently centered along the light path at each target, thereby ensuring that the light source is aligned such that the light beam is coaxial with the ion storage location and/or ion beam path in the mass spectrometer. Initial coarse alignment using target apertures needs to be achieved while the mass spectrometer system is at atmospheric pressure and partially disassembled. UVPD, however, takes place in vacuo within the mass spectrometer, and therefore the system needs to be evacuated to test the alignment of the light beam, perhaps requiring several cycles of venting, disassembly, and evacuation of the mass spectrometer if the initial alignment is not satisfactory, further adding to the system down time. In addition, photo-dissociation experiments performed under such ex vacuo alignment conditions may lead to suboptimal performance.

Therefore, there is a need for a method of aligning a light beam within a mass spectrometer that reduces or eliminates the problems described above.

SUMMARY

In one embodiment, a method of aligning a light beam within a mass spectrometer includes providing precursor ions along a longitudinal axis of the mass spectrometer at two or more locations spatially separated along the longitudinal axis of the mass spectrometer, the precursor ions forming in-vacuum targets. The method then includes directing a light beam from a light source in a direction along the longitudinal axis of the mass spectrometer, the light beam photo-dissociating the precursor ions, and monitoring a mass spectrometer ion signal from each of the two or more precursor ion locations while adjusting the direction of the light beam, thereby aligning the light beam within the mass spectrometer in vacuo. The light source can be a laser light source. In certain embodiments, locating precursor ions along the longitudinal axis of the mass spectrometer can include chopping a beam of precursor ions and timing the light source to dissociate the precursor ions at each of the two or more locations along the longitudinal axis of the mass spectrometer.

The method can include locating precursor ions within an ion trap. In certain embodiments, the method can further include displacing precursor ions from a geometric center of the ion trap. In some embodiments, the method can further include modulating a size of trapped ion population at one or more precursor ion location, by, for example, modulating an ion population radial size by modulating the number of ions stored at the precursor ion location, and/or modulating an amplitude of an oscillatory potential applied to the ion trap. In certain embodiments, the ion trap can be an ion cyclotron resonance (ICR) ion trap. In other embodiments, the ion trap can be a radiofrequency (RF) linear quadrupole ion trap, such as a segmented RF linear quadrupole ion trap. In these specific embodiments, the method can further include trapping precursor ions within any combination of a front segment, a center segment, and a back segment of the segmented RF linear quadrupole ion trap and subsequently irradiating stored precursor ions within each location separately. In some embodiments, the RF linear quadrupole ion trap can be a dual cell RF linear quadrupole ion trap having two cells serially arranged along the longitudinal axis of the mass spectrometer. In these specific embodiments, the method can further include trapping precursor ions within any combination of a front segment, a center segment, and a back segment of each of the two cells of the dual cell RF linear quadrupole ion trap and subsequently irradiating stored precursor ions within each location separately.

In some embodiments, monitoring the mass spectrometer ion signal can include monitoring a precursor ion signal, and/or monitoring a photo-dissociation product ion signal. In certain embodiments, monitoring the mass spectrometer ion signal can include monitoring a ratio between photo-dissociation product ion signal and precursor ion signal, and/or monitoring a fragmentation efficiency of the precursor ions. In some embodiments, the method can further include deriving an index of quality of alignment of the light beam based on the mass spectrometer ion signal.

In another embodiment, a method of monitoring alignment of a light beam within a mass spectrometer includes providing precursor ions along a longitudinal axis of the mass spectrometer at two or more locations spatially separated along the longitudinal axis of the mass spectrometer. The method then includes directing a light beam from a light source in a direction along the longitudinal axis of the mass spectrometer, the light beam photo-dissociating the precursor ions, and monitoring a ratio between photo-dissociation product ion signal and precursor ion signal from each of the two or more precursor ion locations while adjusting the direction of the light beam, optimally obtaining equal amounts of product ion production and precursor ion conversion at the two or more locations along the longitudinal axis of the mass spectrometer. The light source can be a laser light source. The method can further include locating precursor ions within an ion trap. In some embodiments, the method can further include modulating a size of precursor ion location at one or more precursor ion location, by, for example, modulating an ion population radial size by modulating the number of ions stored at the precursor ion location, and/or modulating an amplitude of an oscillatory potential applied to the ion trap. In certain embodiments, the ion trap can be an ion cyclotron resonance (ICR) ion trap. In other embodiments, the ion trap can be a radiofrequency (RF) linear quadrupole ion trap, such as a segmented RF linear quadrupole ion trap. In these specific embodiments, the method can further include trapping precursor ions within any combination of a front segment, a center segment, and a back segment of the segmented RF linear quadrupole ion trap and subsequently irradiating stored precursor ions within each location separately. In some embodiments, the RF linear quadrupole ion trap can be a dual cell RF linear quadrupole ion trap having two cells serially arranged along the longitudinal axis of the mass spectrometer. In these specific embodiments, the method can further include trapping precursor ions within any combination of a front segment, a center segment, and a back segment of each of the two cells of the dual cell RF linear quadrupole ion trap and subsequently irradiating stored precursor ions within each location separately.

This invention has many advantages, such as enabling alignment of a UVPD mass spectrometer system without venting or disassembly of the system, and monitoring of the alignment of the light beam during operation of the mass spectrometer. In addition, this alignment schema provides optimized alignment regardless of manufacturing variance from system to system. It also ensures that the light source will occupy the central axis of the ion path thereby minimizing light incident upon unwanted hardware surfaces. This alignment minimizes unwanted background and chemical noise associated with UV light incident upon hardware surfaces.

BRIEF DESCRIPTION OF THE DRAWINGS

Like reference numerals refer to corresponding parts throughout the several views of the drawings.

DETAILED DESCRIPTION OF EMBODIMENTS

Figure 1:
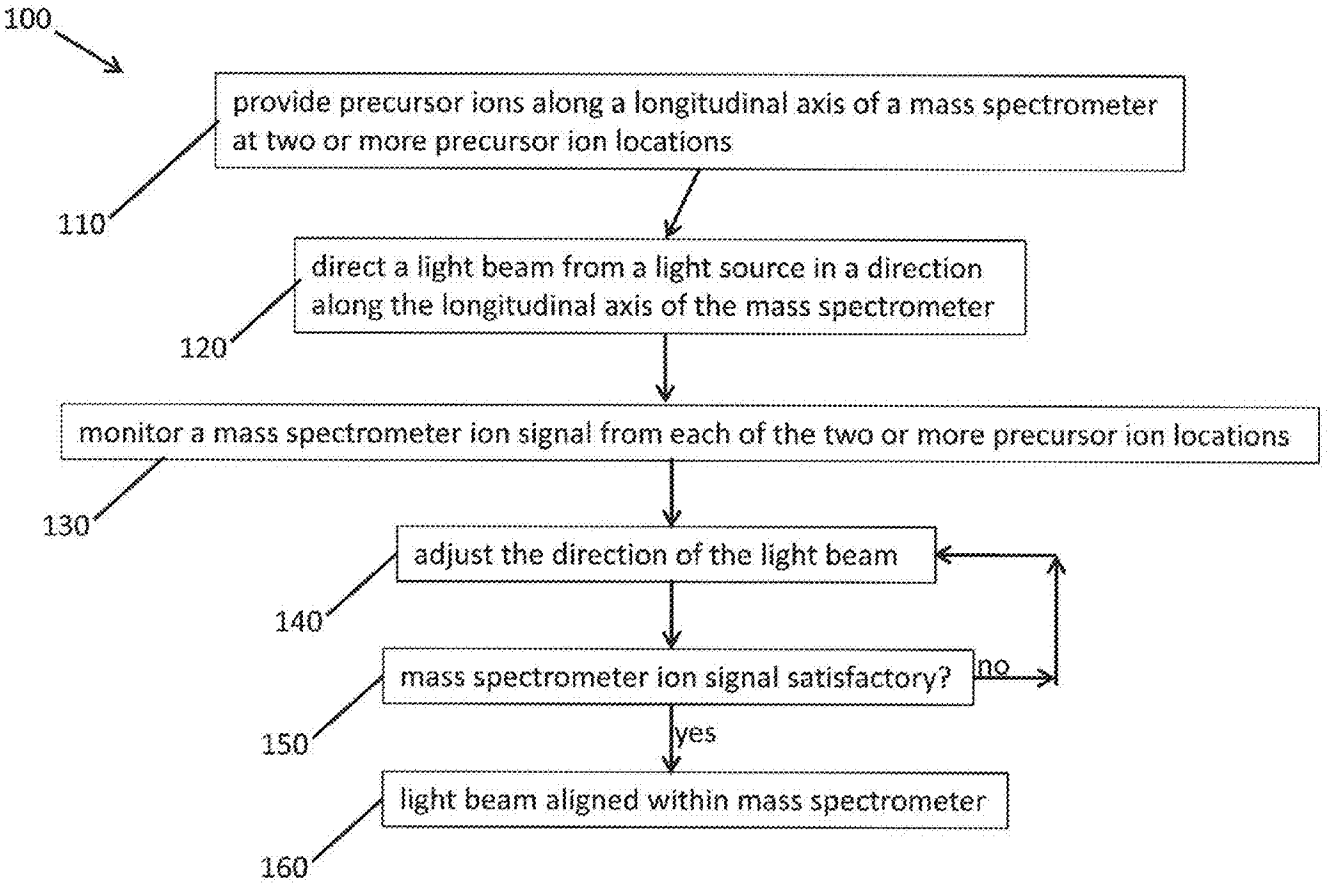
FIG. 1 is a flowchart of an exemplary method of aligning a light beam within a mass spectrometer according to the invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

Figure 2:
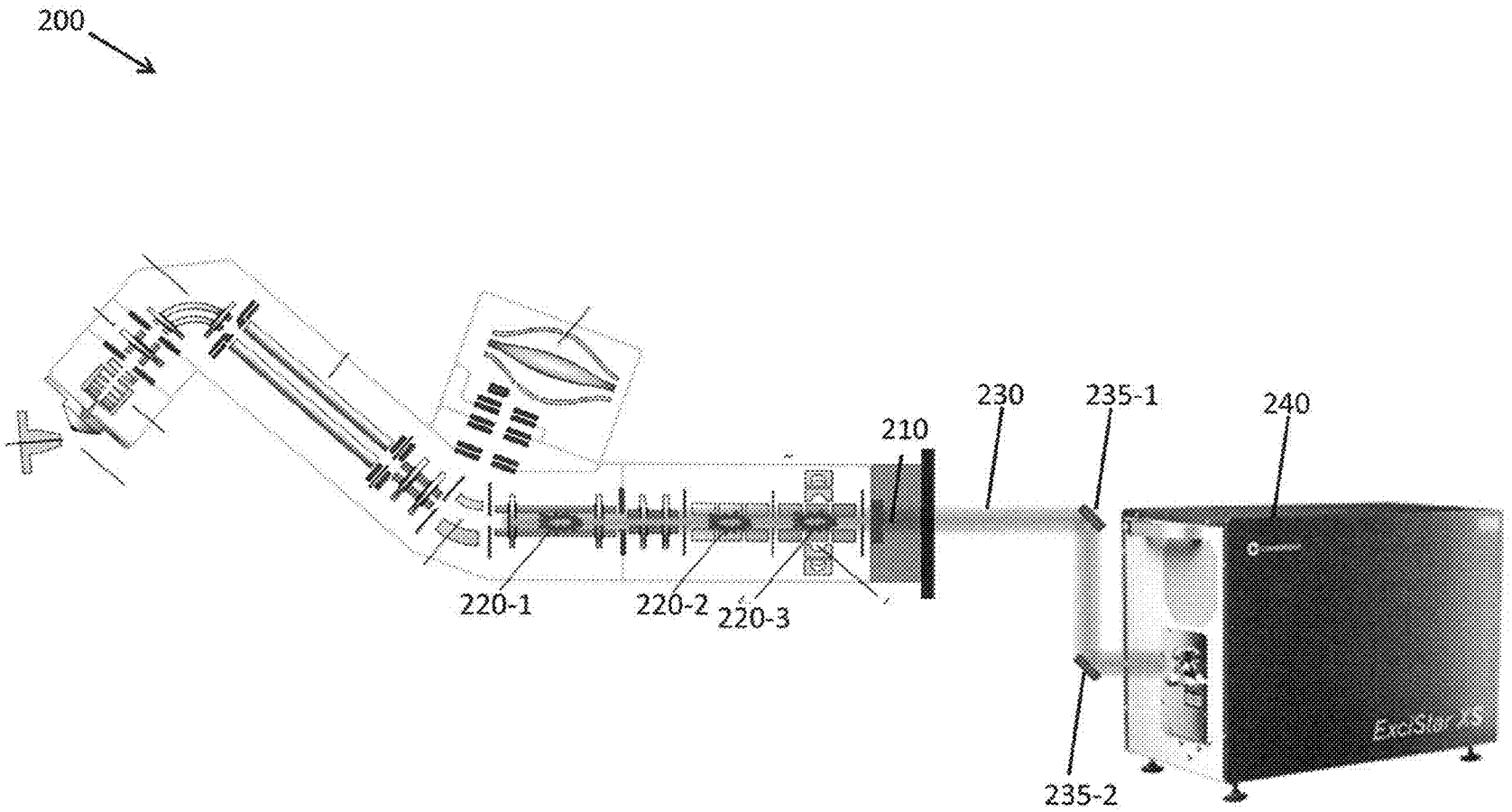
FIG. 2 is a schematic illustration of a mass spectrometer in which the method shown in FIG. 1 is implemented.

In one embodiment, shown as a flowchart in FIG. 1 using an apparatus illustrated in FIG. 2, a method 100 of aligning a light beam within a mass spectrometer 200 includes providing at step 110 precursor ions along a longitudinal axis 210 of the mass spectrometer 200 at two or more precursor ion locations 220, three precursor ion locations 220-1, 220-2, and 220-3 shown in FIG. 2, the precursor ion locations 220 being spatially separated along the longitudinal axis 210 of the mass spectrometer 200, the precursor ions forming in-vacuum targets. The method 100 then includes directing at step 120 a light beam 230 from a light source 240 in a direction along the longitudinal axis 210 of the mass spectrometer 200, the light beam 230 photo-dissociating the precursor ions, and monitoring at step 130 a mass spectrometer ion signal from each of the two or more precursor ion locations 220 while adjusting at step 140 the direction of the light beam 230 using, for example, mirrors 235-1 and 235-2, to determine at step 150 whether the mass spectrometer ion signal is satisfactory, thereby aligning at step 160 the light beam 230 within the mass spectrometer 200. The light source 240 shown in FIG. 2 is a laser light source, such as a pulsed or continuous laser light source. In other embodiments, a convergent or divergent light source, together with suitable collimating optics (not shown), can also be used as the light source 240. Suitable light sources include UV light sources ($\lambda$<400 nm, e.g., 213 nm) and infrared light sources suitable for infrared multiphoton dissociation (IRMPD). In the special case where alignment is made with a well collimated and narrow beam light source, such as a solid state laser source, the tolerance for error in alignment between the ion cloud (target) and the laser beam is very small. Without the method described herein, alignment of lasers of this type (e.g., having a beam radius <1.00 mm dia.) is substantially more difficult, time consuming, and perhaps not readily possible.

Figure 3A:
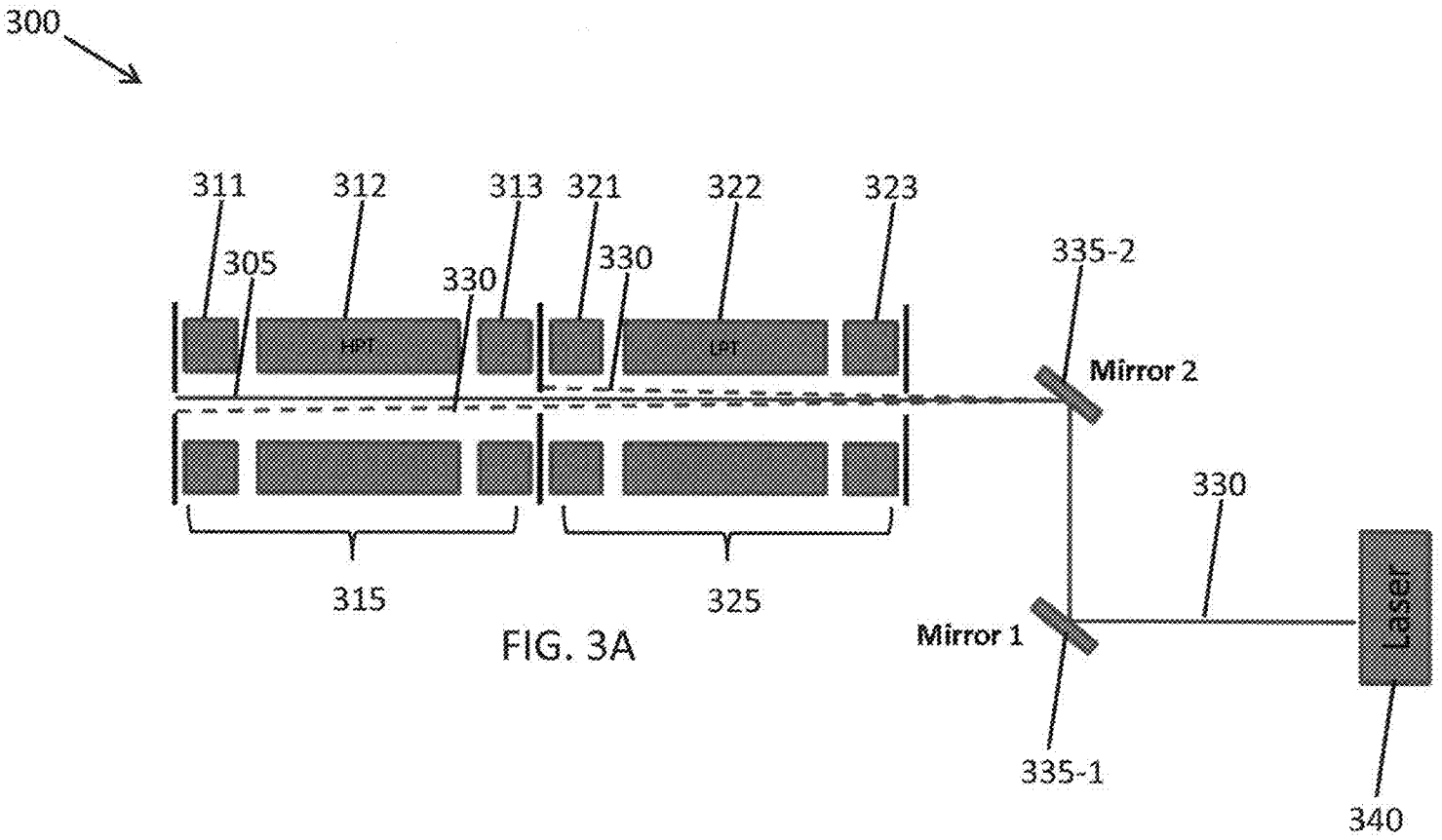
FIG. 3A is a schematic illustration of an exemplary ion trap in which the method shown in FIG. 1 is implemented.
Figure 3B:
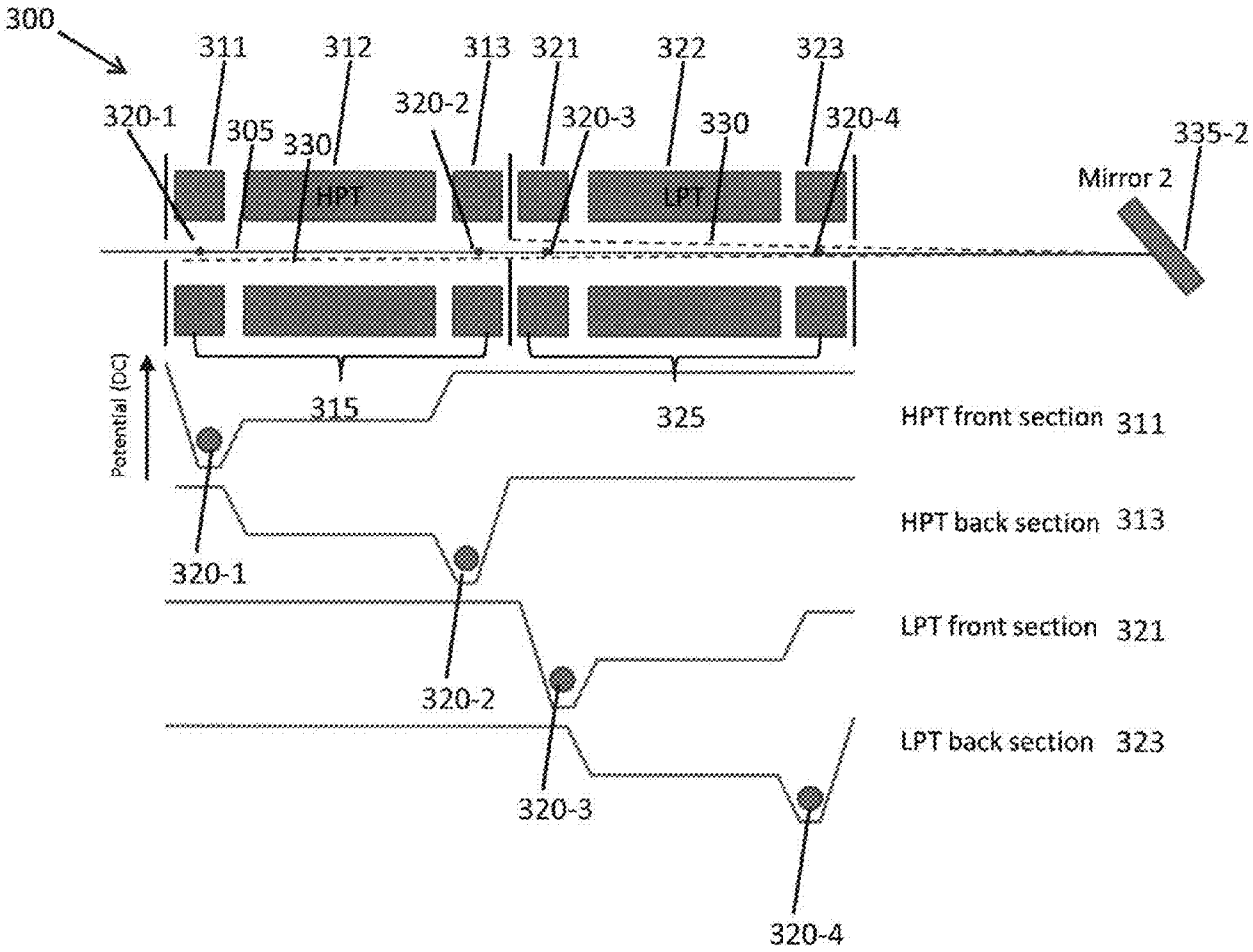
FIG. 3B is a schematic illustration of in vacuo laser alignment using ion cloud storage locations as targets for the laser beam.

The method 100 can be used to align a light beam 230 in a variety of ion traps. In one embodiment, the method 100 can include locating precursor ions within a dual cell segmented radiofrequency (RF) linear quadrupole ion trap 300 shown in FIGS. 3A and 3B. The RF linear quadrupole ion trap 300 is a dual cell RF linear quadrupole ion trap having two radially symmetric cells 315 and 325 serially arranged along the longitudinal axis 305 of the mass spectrometer (not shown). For details of the cells, see U.S. Pat. No. 8,198,580 B2 to Schwartz et al., hereby incorporated by reference in its entirety (however, where anything in the incorporated reference contradicts anything stated in the present application, the present application prevails). Each of the two cells 315 and 325 of the dual cell RF linear quadrupole ion trap 300 includes a front segment 311 and 321, a center segment 312 and 322, and a back segment 313 and 323, respectively. As shown in FIG. 3B, precursor ions are trapped within any combination of these segments in precursor ion locations 320, four precursor ion locations 320-1, 320-2, 320-3, and 320-4 being shown in FIG. 3B, by application of appropriate DC offset potentials schematically illustrated in FIG. 3B. The direction of the light beam 330 originating from light source 340 is adjusted by mirrors 335-1 and 335-2 to photo-dissociate the precursor ions in the ion trap 300. An increase in product ion signal and/or a decrease in precursor ion signal at the precursor ion locations 320 directionally guide the adjustment of mirrors 335-1 and 335-2. If the light beam 330 is misaligned, then only some of the precursor ion locations 320 will be irradiated by the light beam 330, as shown in FIG. 3B. If the light beam 330 is aligned and coaxial with the precursor ion locations 320, precursor ion signal and product ion signal achieved through post-irradiation mass analysis are each equivalent in magnitude. This also means, given the geometric constraint of the precursor ion locations 320, an equivalent fraction of the beam overlaps or intersects with each precursor ion location 320. Incremental adjustment of mirrors 335-1 and 335-2 is iterated to achieve both maximum fragmentation efficiency and to minimize the difference in ion signal between the traps (precursor or product ion signal).

Figure 4:
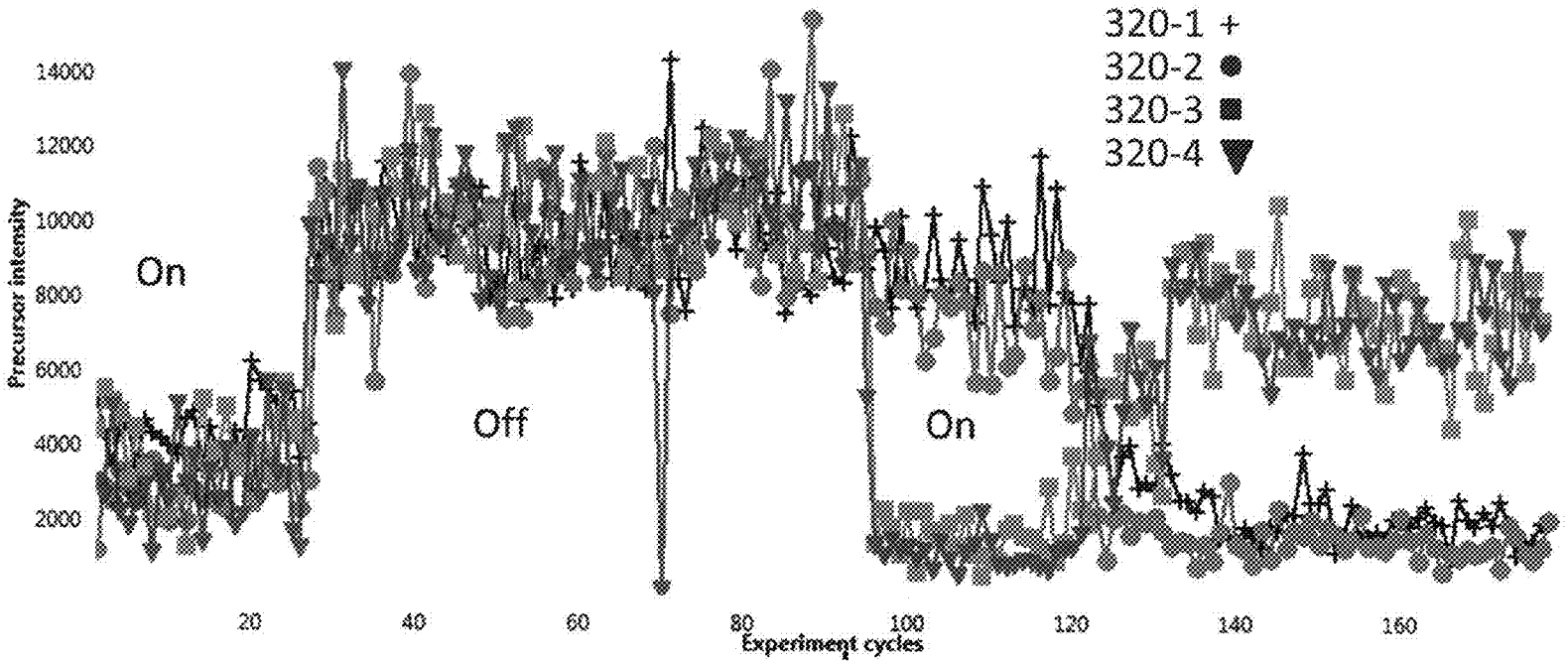
FIG. 4 is a graph of precursor intensity as a function of experiment cycles.

The dual cell RF linear quadrupole ion trap 300 is used to manipulate the position of precursor ions in each experimental cycle such that the ions occupy a different position 320 along the longitudinal axis 305 of the ion trap 300. Each position 320 is analogous to placing a physical target along the longitudinal axis 305 for alignment of the light beam 330. In the exemplary embodiment shown in FIGS. 3A and 3B, during each experimental cycle, ions are placed in one of six storage (precursor ion location) positions, four of which are shown in FIG. 3B (320-1, 320-2, 320-3, 320-4), producing a mass spectrometer ion signal as shown in FIG. 4, for which each ion population was determined to be 1E4 total charges, ion population being controlled by automated gain control. For details of automated gain control, see U.S. Pat. No. 7,312,441 B2 to Land et al., U.S. Pat. No. 7,960,690 B2 to Schwartz et al., and U.S. Pat. No. 9,202,681 B2 to Remes et al., all of these documents being hereby incorporated by reference in their entirety (however, where anything in the incorporated references contradicts anything stated in the present application, the present application prevails). In one aspect, the method further includes displacing precursor ions from a geometric center of the ion trap by, for example, superimposing a DC dipole field polarized in either the X or Y coordinates of the ion trap to displace the center of the ion cloud off the central/neutral RF field axis. The DC dipole field is produced by applying differential DC potentials between opposing rod segments of the ion trap. Alternatively, a differential component of the trapping RF (in phase or antiphase) potential can be superimposed between one of the opposing rod pairs of the ion trap to shift the field's neutral axis in the direction of polarization of the superimposed DC dipole RF field, and thus shift the ion cloud position relative to the geometrical central axis. Modulating the intensity of the differential RF displaces the ion cloud in a similar manner to displacement by the similarly polarized differential DC field, but has the advantage that the differential RF shifts the field center without exciting the ions. Displacing precursor ions from the geometric center of the ion trap provides another way to determine the direction in which the alignment of the mirrors 335-1 and 335-2 needs to be adjusted.

In one aspect, the mass spectrum is used as output for direct interpretation of the quality of the alignment. One can utilize the depletion of the precursor ions for the resulting spectrum, or the generation of photo-dissociation product ions as a response. The responses from each location are plotted together, and if all traces overlap sufficiently, then that indicates that the light beam is coaxial or parallel to each precursor ion location along its path. Response overlap does not indicate that maximum fragmentation efficiency has been achieved, however. For maximum fragmentation efficiency, maximum overlap between the light source and the ion cloud must be attained. This is achieved through progressive iteration of beam alignment, translating the beam through the available x-y space. FIG. 4 shows a plot of the mass spectrometer ion signal response obtained from the iteration process using apomyoglobin $[M+19H]^{19+}$ as the precursor ion. Precursor ion mass spectrometer ion signal was monitored as alignment was adjusted. The variability in the precursor ion signal between consecutive experiment cycles is due to fluctuations in the ion flux from the electrospray ionization source used to generate the precursor ions. The larger variations are due to differences in the exposure of precursor ions to photons either from alignment of the photon beam with the trapped precursor ion cloud in their respective positions in the dual cell trap or the turning off and on of the laser. When the laser is initially turned on (0-25 experiment cycles), the data illustrates a state where good alignment has already been achieved in the ion trap 300 shown in FIGS. 3A and 3B. Turning back to FIG. 4, when the laser is turned off as a control (25-100 experiment cycles), the maximum precursor intensity is obtained. If mirror 335-1 is slightly adjusted (100-120 experiment cycles), one can see that the irradiation of the first cell 315 (HPT) has been greatly reduced. In fact, the precursor intensity remaining post irradiation has dramatically increased. This is not the case with the second cell 325 (LPT), however. The light source 340 is still effectively photo-dissociating precursor in the second cell 325. If mirror 335-1 is adjusted in the opposite direction (120-160 experiment cycles), then the opposite effect is induced. In this case, the inflection and intersection point between the mass spectrometer precursor ion signal response traces for the first cell 315 and second cell 325 at approximately experiment cycle 125 represents a state in which the light beam 330 is parallel and coaxial with both locations. In summary, beam position and angle are iteratively adjusted as a result of the response from the mass spectrum until good alignment is achieved. The alignment process can be carried out in a completely automated implementation, using an algorithm to recognize features from response plots and electronic mechanisms for changing beam position and angle.

Figure 5B:
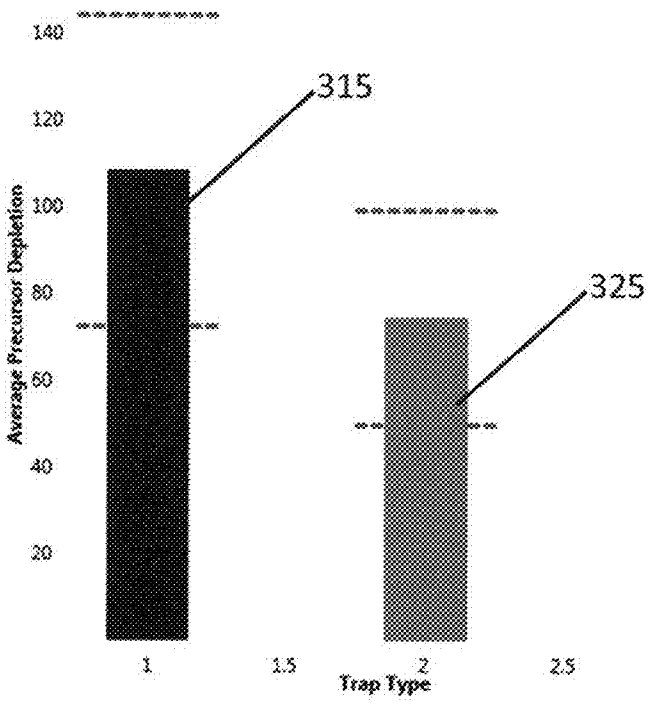
FIG. 5B is a bar graph of average precursor depletion for the HPT and LPT ion traps.
Figure 5A:
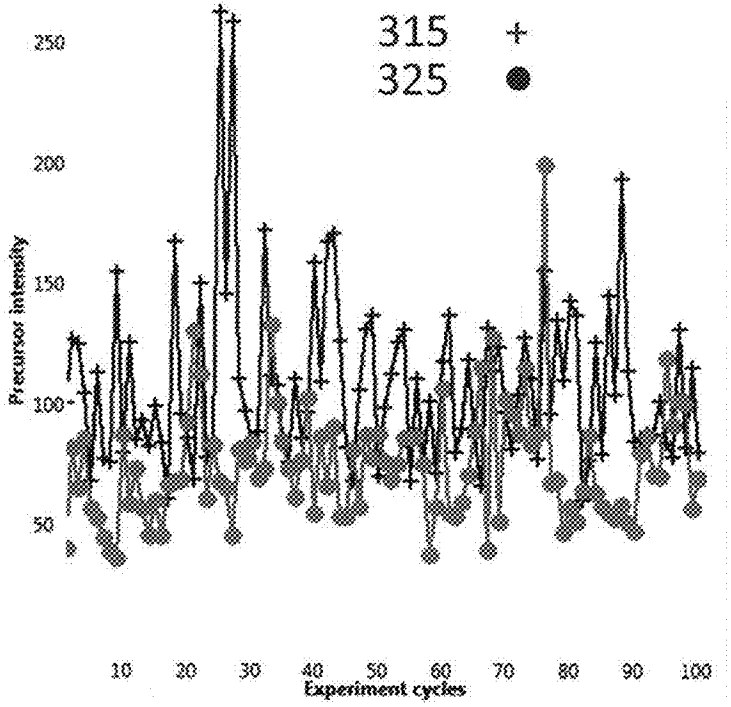
FIG. 5A is another graph of precursor intensity as a function of experiment cycles.

In some embodiments, the method can further include deriving an index of quality of alignment of the light beam or an alignment quality score based on the mass spectrometer ion signal. A change in the alignment quality score is used to directionally guide the adjustment of mirrors 335-1 and 335-2. FIGS. 5A and 5B show data acquired to assess the quality of an alignment as a diagnostic or calibration strategy based on precursor ion signal intensity and precursor ion depletion. Precursor intensity is nearly the same in each cell 315 (HPT) and 325 (LPT). The response was averaged and shown as a bar plot in FIG. 5B. An absolute tolerance for the response and a tolerance for relative response between irradiation locations (i.e., precursor ion locations 320) can be used to control for alignment variations over time.

Figure 6:
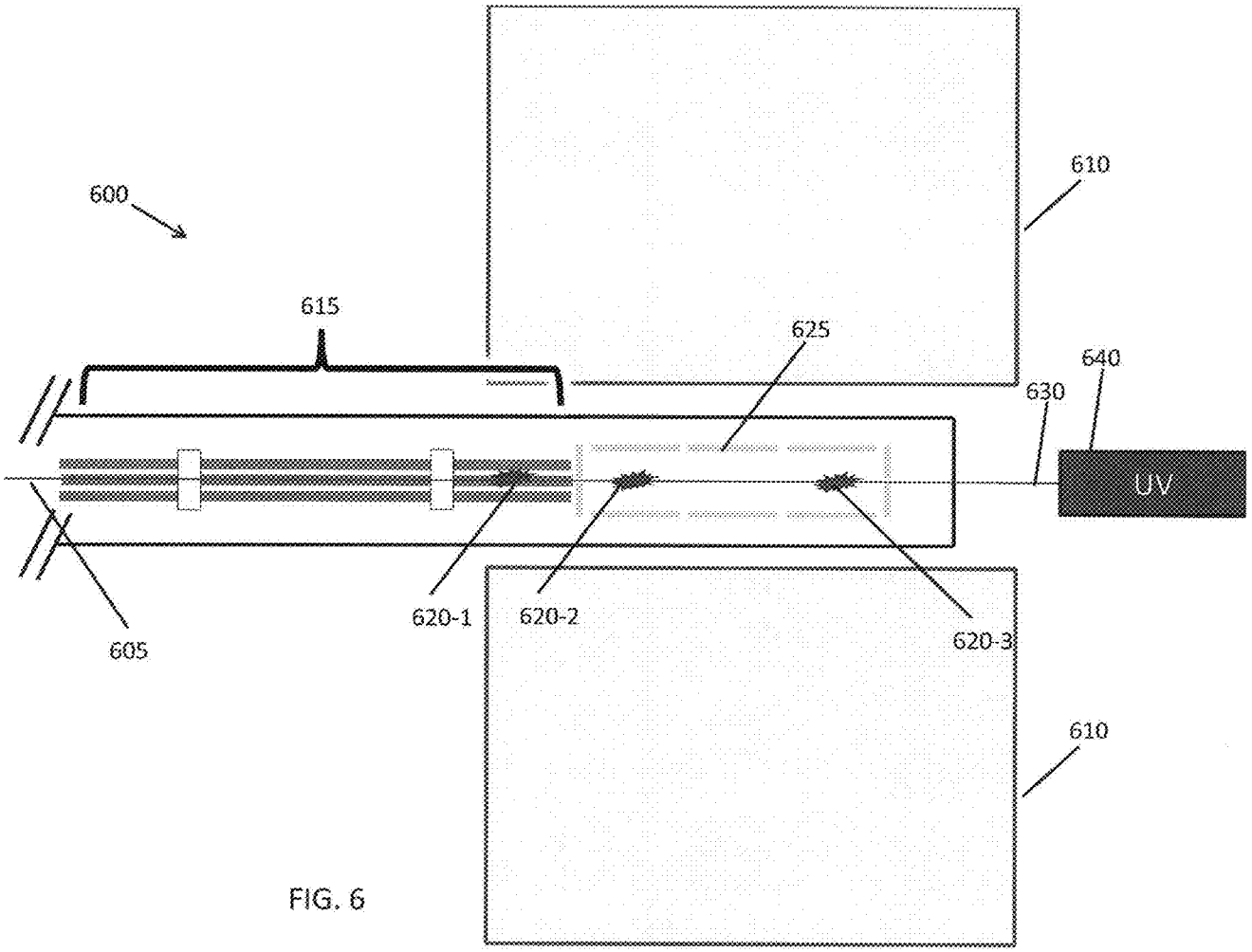
FIG. 6 is a schematic illustration of an ion cyclotron resonance (ICR) mass spectrometer in which the method shown in FIG. 1 is implemented.

The alignment method described herein is not limited to alignment of light beams, as it is also suitable for use with other collimated beam ion dissociation techniques, such as metastable induced dissociation of ions (MIDI) using fast atom bombardment (FAB), metastable atom activated dissociation (MAD), and electron induced dissociation (EID). Furthermore, the alignment method described herein is not limited to RF ion trapping devices, as it is also suitable for any ion trap devices capable of manipulating ions along the axial dimension of the trap, including ion routing multipole (IRM) based devices with a DC gradient. This approach can be extended to Penning trap and beam type mass spectrometers. In another embodiment shown in FIG. 6, the ion trap can be an ion cyclotron resonance (ICR) ion trap 600 that includes an ICR cell 625 where ions are introduced by a multipole ion guide 615 and trapped by super-conducting magnet 610. Precursor ion locations 620-1, 620-2, and 620-3 can be located along the longitudinal axis 605, for alignment of a light beam 630 originating from light source 640, using the alignment method described above.

In some embodiments, the method can further include modulating the size of the precursor ion cloud radius at one or more precursor ion location, by, for example, modulating a precursor ion population size, and/or modulating an amplitude of an oscillatory potential applied to the ion trap. Ion cloud radius is proportional to the number of ions stored in the RF linear quadrupole ion trap or ICR cell. This relationship can be exploited during UVPD alignment by starting with an initially large number of ions in the trap, thereby increasing the overlap of the light beam with the larger ion cloud. This ability to control the radius of the ion cloud allows for greater variance in the starting position of the beam prior to alignment. The alignment procedure would then be carried out as described above, with subsequent alignment iterations carried out with progressively fewer ions, reducing the ion cloud radius and thus the laser target size. Reducing the target size improves the alignment by reducing the angular and offset tolerance acceptable for a good quality alignment. This iteration can be repeated to refine the alignment to the desired amount of ion cloud-laser beam overlap.

The alignment method described above can be adapted to beam-type mass spectrometers, such as time-of-flight mass spectrometers, using a mechanism for discontinuous beam operation. The laser pulse timing can be adjusted to accommodate the discontinuous ion beam such that a variable delay between the two in time should provide analogous precursor ion locations along the beam path. In certain embodiments, locating precursor ions along the longitudinal axis of the mass spectrometer can include chopping a beam of precursor ions and timing the light source to dissociate the precursor ions at each of the two or more locations along the longitudinal axis of the mass spectrometer. In this embodiment, the alignment process would proceed as described above.

Figure 7:
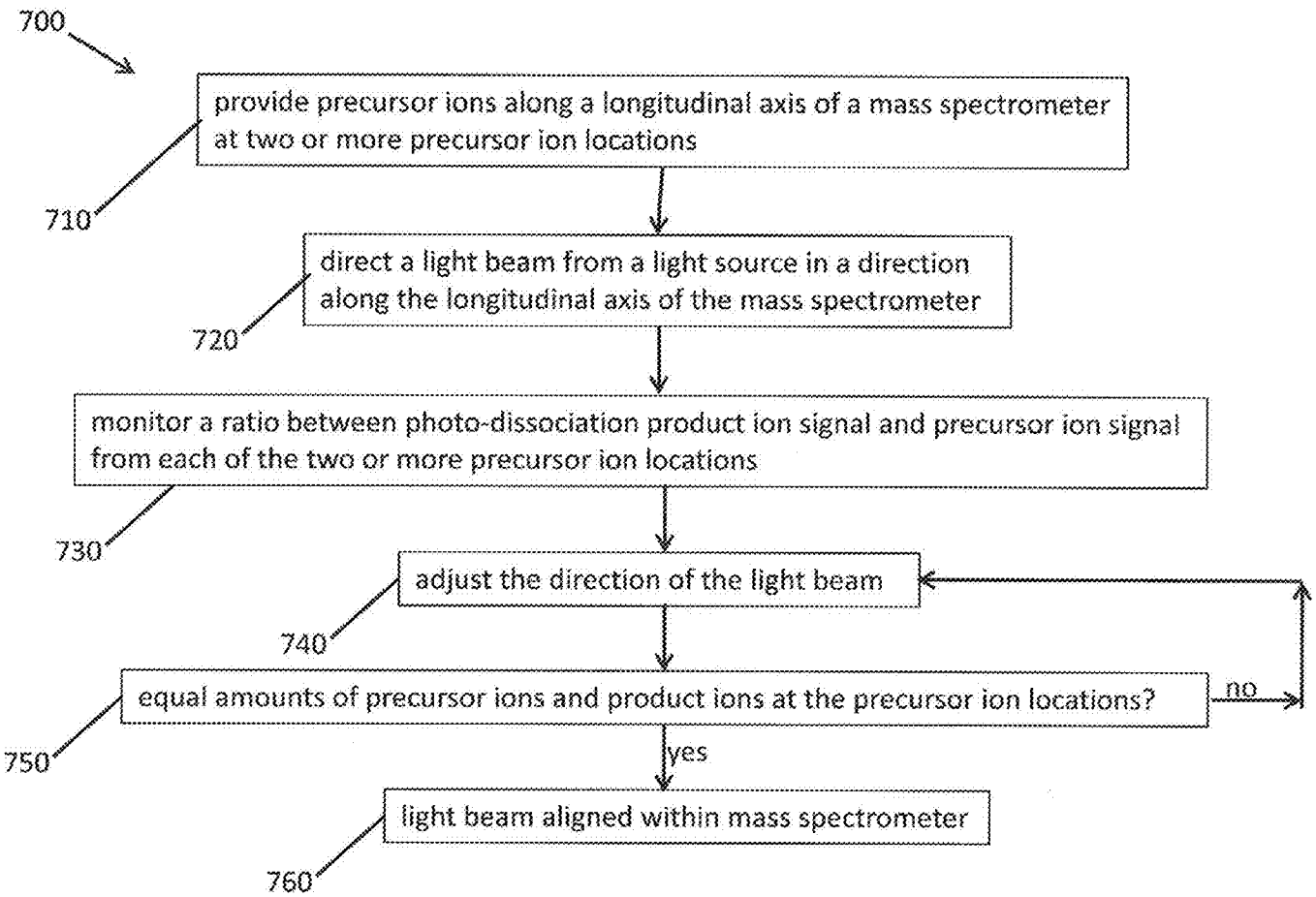
FIG. 7 is a flowchart of an exemplary method of monitoring alignment of a light beam within a mass spectrometer according to the invention.
Figure 8B:
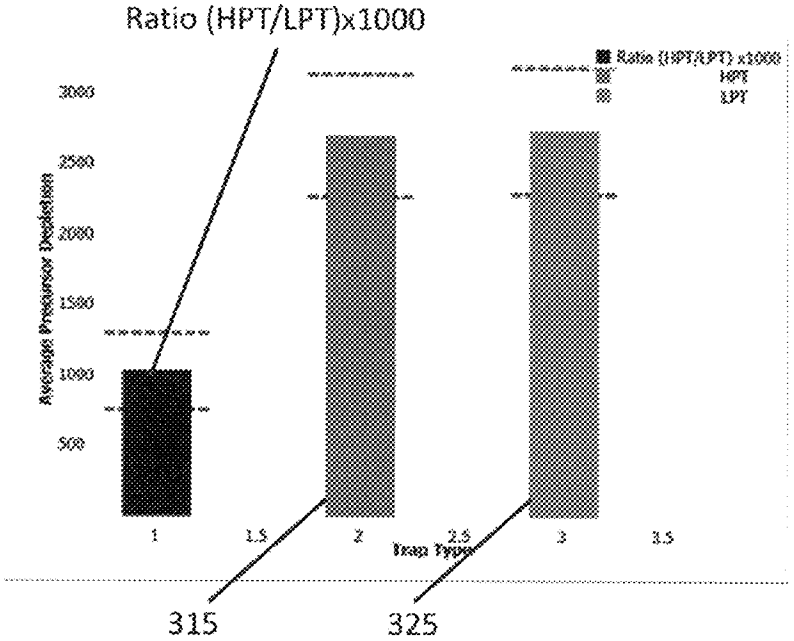
FIG. 8B is a bar graph of average precursor depletion for the HPT and LPT ion traps.
Figure 8A:
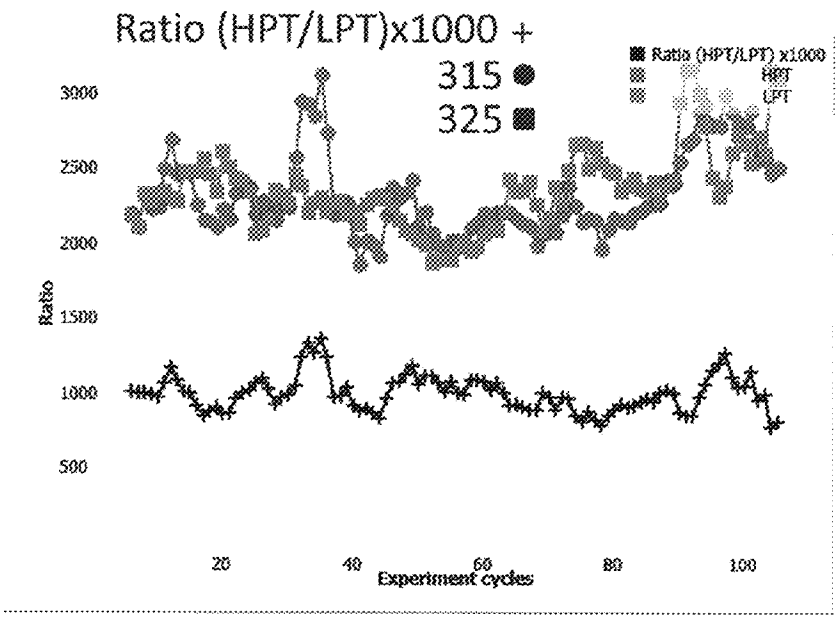
FIG. 8A is a graph of the HPT/LPT ratio (×1000) as a function of experiment cycles.

In another embodiment shown in FIG. 7, a method 700 of monitoring alignment of a light beam within a mass spectrometer includes providing at step 710 precursor ions along a longitudinal axis of the mass spectrometer at two or more precursor ion locations, the precursor ion locations being spatially separated along the longitudinal axis of the mass spectrometer, the precursor ions forming in-vacuum targets. The method 700 then includes directing at step 720 a light beam from a light source in a direction along the longitudinal axis of the mass spectrometer, the light beam photo-dissociating the precursor ions, and monitoring at step 730 a ratio between photo-dissociation product ion signal and precursor ion signal from each of the two or more precursor ion locations while adjusting at step 740 the direction of the light beam, optimally obtaining at step 750 equal amounts of product ion production and precursor ion conversion at the two or more precursor ion locations, as shown in FIGS. 8A and 8B. Under good alignment conditions, the ratio of fragmentation between the two ion traps 315 (HPT) and 325 (LPT) is approximately unity (multiplied by 1000 in FIGS. 8A and 8B). Under suboptimal alignment conditions, as shown at approximately experiment cycle 35 in FIG. 8A, the ratio deviates appreciably from unity, and the direction of the light beam is iteratively readjusted as shown in FIG. 7.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of aligning a light beam within a mass spectrometer, the method comprising:

a. providing precursor ions along a longitudinal axis of a mass spectrometer at two or more precursor ion locations, the precursor ion locations being spatially separated along the longitudinal axis of the mass spectrometer, the precursor ions forming in-vacuum targets;

b. directing a light beam from a light source in a direction along the longitudinal axis of the mass spectrometer, the light beam photo-dissociating the precursor ions; and c. monitoring a mass spectrometer ion signal from each of the two or more precursor ion locations while adjusting the direction of the light beam, thereby aligning the light beam within the mass spectrometer in vacuo.

2. The method of claim 1, further including locating precursor ions within an ion trap.

3. The method of claim 2, further including displacing precursor ions from a geometric center of the ion trap.

4. The method of claim 2, further including modulating a size of precursor ion location at one or more precursor ion location.

5. The method of claim 4, wherein modulating the size of precursor ion location includes modulating an ion population radial size at one or more precursor ion location by modulating the number of ions stored at the precursor ion location.

6. The method of claim 4, wherein modulating the size of precursor ion location includes modulating an amplitude of an oscillatory potential applied to the ion trap.

7. The method of claim 2, wherein the ion trap is an ion cyclotron resonance (ICR) ion trap.

8. The method of claim 2, wherein the ion trap is a radiofrequency (RF) linear quadrupole ion trap.

9. The method of claim 8, wherein the RF linear quadrupole ion trap is a segmented RF linear quadrupole ion trap.

10. The method of claim 9, further including trapping precursor ions within any combination of a front segment, a center segment, and a back segment of the segmented RF linear quadrupole ion trap.

11. The method of claim 8, wherein the RF linear ion trap is a dual cell RF linear quadrupole ion trap having two cells serially arranged along the longitudinal axis of the mass spectrometer.

12. The method of claim 11, further including trapping precursor ions within any combination of a front segment, a center segment, and a back segment of each of the two cells of the dual cell RF linear quadrupole ion trap.

13. The method of claim 1, wherein the light source is a laser light source.

14. The method of claim 1, wherein monitoring the mass spectrometer ion signal includes monitoring a precursor ion signal.

15. The method of claim 1, wherein monitoring the mass spectrometer ion signal includes monitoring a photo-dissociation product ion signal.

16. The method of claim 1, wherein monitoring the mass spectrometer ion signal includes monitoring a ratio between photo-dissociation product ion signal and precursor ion signal.

17. The method of claim 1, wherein monitoring the mass spectrometer ion signal includes monitoring a fragmentation efficiency of the precursor ions.

18. The method of claim 1, further including deriving an index of quality of alignment of the light beam based on the mass spectrometer ion signal.

19. The method of claim 1, wherein locating precursor ions along the longitudinal axis of the mass spectrometer includes chopping a beam of precursor ions and timing the light source to dissociate the precursor ions at each of the two or more locations along the longitudinal axis of the mass spectrometer.

20. A method of monitoring alignment of a light beam within a mass spectrometer, the method comprising:

a. providing precursor ions along a longitudinal axis of a mass spectrometer at two or more precursor ion locations, the precursor ion locations being spatially separated along the longitudinal axis of the mass spectrometer, the precursor ions forming in-vacuum targets;

b. directing a light beam from a light source in a direction along the longitudinal axis of the mass spectrometer, the light beam photo-dissociating the precursor ions; and c. monitoring a ratio between photo-dissociation product ion signal and precursor ion signal from each of the two or more precursor ion locations while adjusting the direction of the light beam, optimally obtaining equal amounts of product ion production and precursor ion conversion at the two or more precursor ion locations.

21. The method of claim 20, further including locating precursor ions within an ion trap.

22. The method of claim 21, further including modulating a size of precursor ion location at one or more precursor ion location.

23. The method of claim 22, wherein modulating the size of precursor ion location includes modulating an ion population radial size at one or more precursor ion location by modulating the number of ions stored at the precursor ion location.

24. The method of claim 22, wherein modulating the size of precursor ion location includes modulating an amplitude of an oscillatory potential applied to the ion trap.

25. The method of claim 21, wherein the ion trap is an ion cyclotron resonance (ICR) ion trap.

26. The method of claim 21, wherein the ion trap is a radiofrequency (RF) linear quadrupole ion trap.

27. The method of claim 26, wherein the RF linear quadrupole ion trap is a segmented RF linear quadrupole ion trap.

28. The method of claim 27, further including trapping precursor ions within any combination of a front segment, a center segment, and a back segment of the segmented RF linear quadrupole ion trap.

29. The method of claim 26, wherein the RF linear quadrupole ion trap is a dual cell RF linear quadrupole ion trap having two cells serially arranged along the longitudinal axis of the mass spectrometer.

30. The method of claim 29, further including trapping precursor ions within any combination of a front segment, a center segment, and a back segment of each of the two cells of the dual cell RF linear quadrupole ion trap.

31. The method of claim 20, wherein the light source is a laser light source.

* * * * *